US011285580B2

(12) United States Patent
LeCompte

(10) Patent No.: US 11,285,580 B2
(45) Date of Patent: Mar. 29, 2022

(54) RUST INHIBITING SYSTEM AND METHOD OF USE

(71) Applicant: MMLJ, Inc., Houston, TX (US)

(72) Inventor: Benjamin LeCompte, Houston, TX (US)

( * ) Notice: Subject to any disclaimer, the term of this patent is extended or adjusted under 35 U.S.C. 154(b) by 260 days.

(21) Appl. No.: 16/736,595

(22) Filed: Jan. 7, 2020

(65) Prior Publication Data

US 2020/0262030 A1 Aug. 20, 2020

Related U.S. Application Data

(63) Continuation-in-part of application No. 15/812,206, filed on Nov. 14, 2017, now Pat. No. 10,569,386, which is a continuation-in-part of application No. 15/712,453, filed on Sep. 22, 2017, now Pat. No. 10,449,657, which is a continuation-in-part of application No. 14/848,330, filed on Sep. 8, 2015, now Pat. No. 9,844,851, which is a continuation-in-part of application No. 14/773,694, filed on Sep. 8, 2015, now Pat. No. 9,849,560, which is a continuation-in-part of application No. 14/848,330, filed on Sep. 8, 2015, now Pat. No. 9,844,851, which is a continuation-in-part of application No. PCT/US2014/022170, filed on Mar. 7, 2014.

(60) Provisional application No. 62/880,540, filed on Jul. 30, 2019, provisional application No. 61/773,816, filed on Mar. 7, 2013.

(51) Int. Cl.

| | |
|---|---|
| ***B24C 1/08*** | (2006.01) |
| ***B24C 7/00*** | (2006.01) |
| ***B24C 11/00*** | (2006.01) |
| ***C23F 11/08*** | (2006.01) |
| *B24C 5/04* | (2006.01) |

(52) U.S. Cl.

CPC ..... *B24C 1/086* (2013.01); *B24C 7/0046* (2013.01); *B24C 11/005* (2013.01); *C23F 11/08* (2013.01); *B24C 5/04* (2013.01)

(58) Field of Classification Search

CPC ..... B24C 11/005; B24C 1/086; B24C 5/04; B24C 7/0046; C23F 11/08

See application file for complete search history.

(56) References Cited

U.S. PATENT DOCUMENTS 3,343,304 A * 9/1967 Eppler ..... B24C 9/003 451/99

5,195,280 A * 3/1993 Nicholson ..... B05B 7/1436 451/101

(Continued)

*Primary Examiner* — Marc Carlson

(74) *Attorney, Agent, or Firm* — Shannon Warren

(57) ABSTRACT

A rust inhibiting process for cleaning and protecting a target object is disclosed. Comprising mixing at least a rust inhibitor and a fluid into a slurry mixture, spraying the slurry mixture at the target object from within a reservoir of a slurry blasting system, separating a tarnished top layer and a parent metal of the target object with a slurry stream, cleaning the parent metal with the rust inhibitor, preventing the parent metal from impregnating with contaminants during cleaning with the rust inhibitor, and protecting the parent metal with the rust inhibitor after spraying is complete. The slurry stream comprises the slurry mixture of the slurry blasting system being sprayed with the slurry blasting system. The slurry blasting system comprises a tank.

6 Claims, 10 Drawing Sheets

(56) References Cited

U.S. PATENT DOCUMENTS

| | | | | |
|---|---|---|---|---|
| 5,827,114 | A * | 10/1998 | Yam | B24C 7/0038 451/75 |
| 2016/0158915 | A1* | 6/2016 | Adan | B24C 3/06 451/40 |
| 2017/0225297 | A1* | 8/2017 | Trull, Jr. | B24C 7/0076 |
| 2018/0043408 | A1* | 2/2018 | Nakano | B24C 5/04 |
| 2018/0169835 | A1* | 6/2018 | Eliason | B24B 57/02 |

* cited by examiner

RUST INHIBITING SYSTEM AND METHOD OF USE

CROSS-REFERENCE TO RELATED APPLICATIONS

This application claims benefit to U.S. Patent Application Nos. 61/773,816 filed on 2013 Mar. 7, PCT/US14/22170 filed on 2014 Mar. 7, Ser. No. 14/773,694 filed on 2015 Sep. 8, Ser. No. 62/398,225 filed on 2016 Sep. 22, Ser. No. 15/712,453 filed on 2017 Sep. 22, Ser. No. 14/848,330 filed on 2015 Sep. 8, Ser. No. 15/812,206 filed on 2017 Nov. 14, and Ser. No. 62/880,540 filed on 2019 Jul. 30.

STATEMENT REGARDING FEDERALLY SPONSORED RESEARCH OR DEVELOPMENT (IF APPLICABLE)

Not applicable.

REFERENCE TO SEQUENCE LISTING, A TABLE, OR A COMPUTER PROGRAM LISTING COMPACT DISC APPENDIX (IF APPLICABLE)

Not applicable.

BACKGROUND OF THE INVENTION

No prior art is known to the Applicant.

BRIEF SUMMARY OF THE INVENTION

A rust inhibiting process 100 for cleaning and protecting a target object 902 is disclosed. Comprising mixing at least a rust inhibitor 620 and a fluid 618 into a slurry mixture 608, spraying said slurry mixture 608 at said target object 902 from within a reservoir 610 of a slurry blasting system 202, separating a tarnished top layer 906 and a parent metal 904 of said target object 902 with a slurry stream 908, cleaning said parent metal 904 with said rust inhibitor 620, preventing said parent metal 904 from impregnating with contaminants during cleaning with said rust inhibitor 620, protecting said parent metal 904 with said rust inhibitor 620 after spraying is complete, storing said slurry mixture 608 within a tank 204, injecting a compressed air 1012 into a lower end of a center tube 228, opening a gap between said center tube 228 and said tank 204, receiving a portion of said slurry mixture 608 into said compressed air 1012, and selectively spraying a portion of said slurry mixture 608 at said target object 902. Said slurry stream 908 comprises said slurry mixture 608 of said slurry blasting system 202 being sprayed with said slurry blasting system 202. Said slurry blasting system 202 comprises said tank 204. A center tube 606. An inlet 216. A first spraying assembly 804. Said reservoir 610. Said inlet 216 is configured to receive said compressed air 1012 from an air compressor 1002. Said first spraying assembly 804 is attached to said center tube 606 and receives a portion of said slurry mixture 608 and directs it at said target object 902. Said tank 204 further comprises a conical lower portion 226 attached to said inlet 216 through A coupler 622. Said coupler 622 receives said compressed air 1012 from said air compressor 1002. Said center tube 228 selectively opens and closes with said coupler 622 to allow portions of said slurry mixture 608 to pass into said center tube 228. Said center tube 228 is attached to a blast nozzle 1006 configured to selectively allow said slurry mixture 608 to spray out of said slurry blasting system 202.

Said rust inhibiting process 100 for cleaning and protecting said target object 902 is disclosed. Comprising mixing at least said rust inhibitor 620 and said fluid 618 into said slurry mixture 608, spraying said slurry mixture 608 at said target object 902 from within said reservoir 610 of said slurry blasting system 202, separating said tarnished top layer 906 and said parent metal 904 of said target object 902 with said slurry stream 908, cleaning said parent metal 904 with said rust inhibitor 620, preventing said parent metal 904 from impregnating with contaminants during cleaning with said rust inhibitor 620, and protecting said parent metal 904 with said rust inhibitor 620 after spraying is complete. Said slurry stream 908 comprises said slurry mixture 608 of said slurry blasting system 202 being sprayed with said slurry blasting system 202. Said slurry blasting system 202 comprises said tank 204. Said center tube 606. Said inlet 216. Said first spraying assembly 804. Said reservoir 610. Said inlet 216 is configured to receive said compressed air 1012 from said air compressor 1002. Said first spraying assembly 804 is attached to said center tube 606 and receives a portion of said slurry mixture 608 and directs it at said target object 902.

DETAILED DESCRIPTION OF THE INVENTION

The following description is presented to enable any person skilled in the art to make and use the invention as claimed and is provided in the context of the particular examples discussed below, variations of which will be readily apparent to those skilled in the art. In the interest of clarity, not all features of an actual implementation are described in this specification. It will be appreciated that in the development of any such actual implementation (as in any development project), design decisions must be made to achieve the designers' specific goals (e.g., compliance with system- and business-related constraints), and that these goals will vary from one implementation to another. It will also be appreciated that such development effort might be complex and time-consuming, but would nevertheless be a routine undertaking for those of ordinary skill in the field of the appropriate art having the benefit of this disclosure. Accordingly, the claims appended hereto are not intended to be limited by the disclosed embodiments, but are to be accorded their widest scope consistent with the principles and features disclosed herein.

Figure 1:
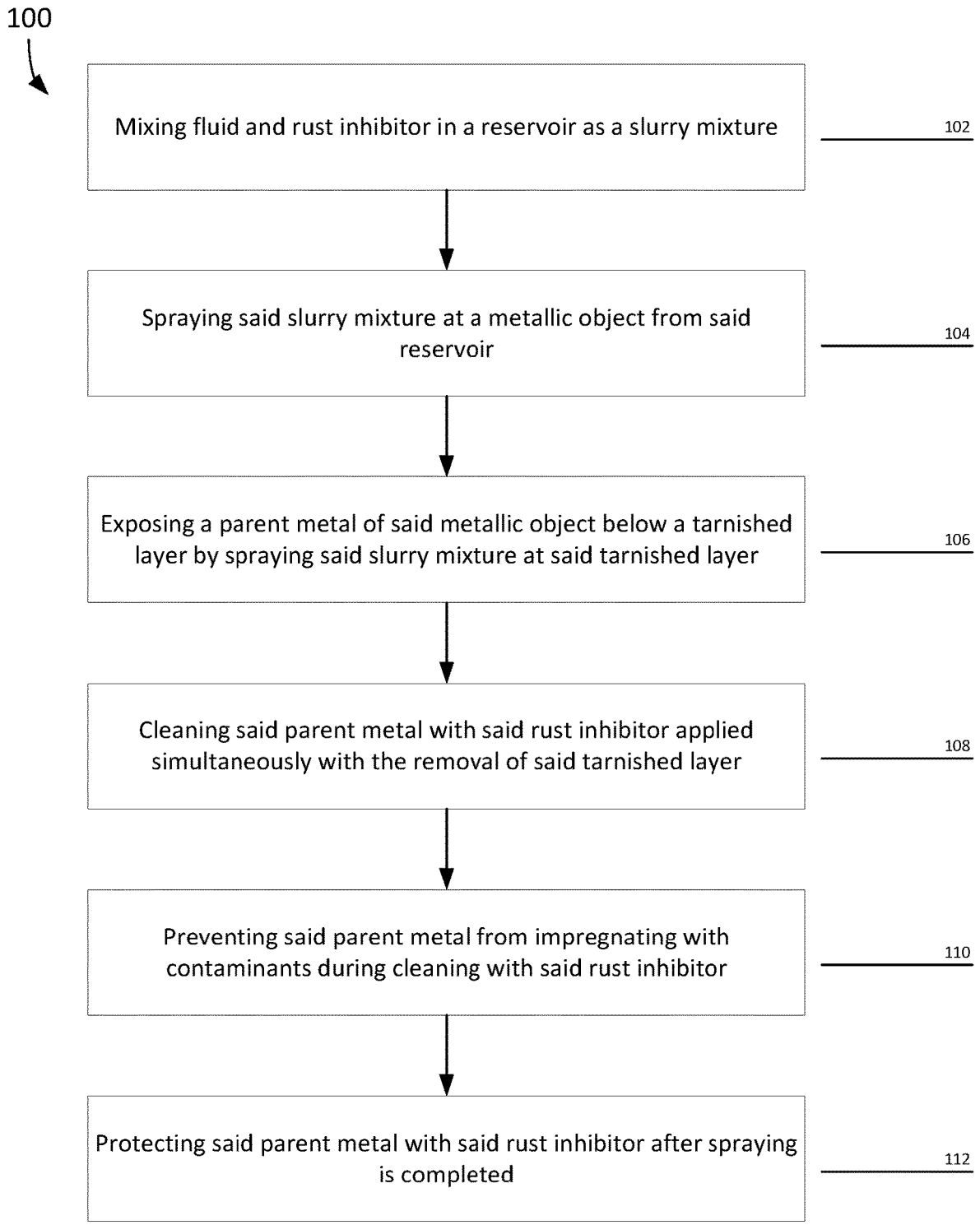
FIG. 1 illustrates a flow chart of a rust inhibiting process 100.

FIG. 1 illustrates a flow chart of a rust inhibiting process 100.

In one embodiment, said rust inhibiting process 100 can comprise a mixing step 102, a spraying step 104, an exposing step 106, a cleaning step 108, a preventative step 110 and a protecting step 112. Details of said rust inhibiting process 100 are outlined below as embodiments of each step in said rust inhibiting process 100.

Incorporated by reference, PCT/US14/22170 provides a more detailed description of the parts shown in FIGS. 2-5B and 10; and claimed hereafter.

Figure 2:
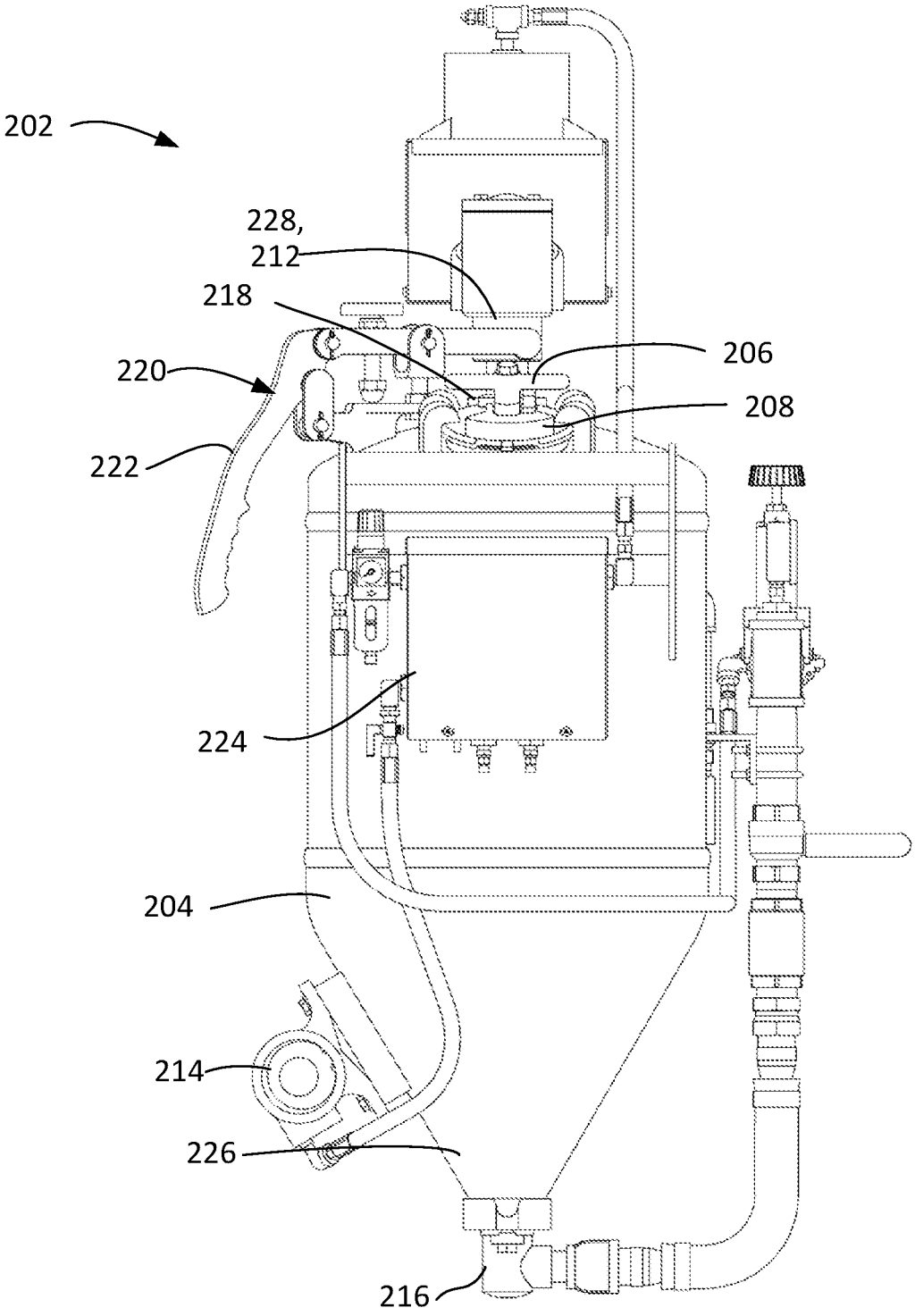
FIG. 2 illustrates an elevated front view of a slurry blasting system 202.

FIG. 2 illustrates an elevated front view of a slurry blasting system 202.

In one embodiment, said slurry blasting system 202 can comprise a tank 204, a bleed valve 206, a venting cap 208, an outlet 212, a vibrator 214, an inlet 216, a collar element 218, a position locking assembly 220 having a lever 222, and one or more control boxes 224.

In one embodiment, said tank 204 can comprise a conical lower portion 226. Said tank 204 can comprise a reservoir 610 filled with a slurry mixture 608 (illustrated in FIG. 6B). In one embodiment, said slurry mixture 608 can naturally seep down into said conical lower portion 226 and be collected by a center tube 228; In one embodiment, said slurry mixture 608 can be helped to seep through said conical lower portion 226 by said vibrator 214 which can be selectively engaged according to need or user preference.

Figure 3A:
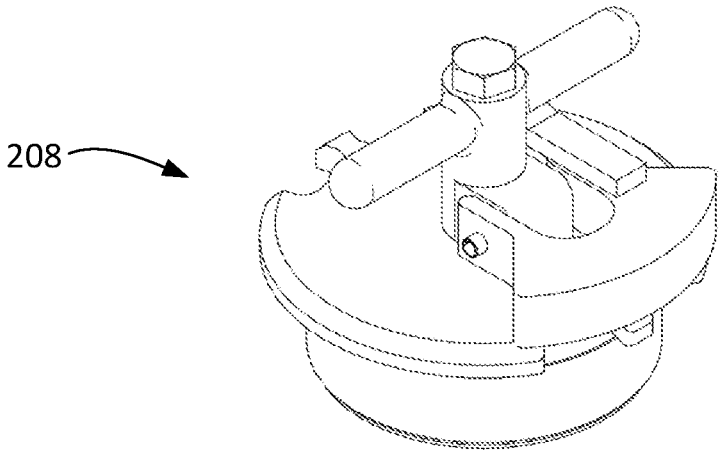
FIGS. 3A, 3B and 3C illustrate a perspective overview, an elevated side view and top view of a venting cap 208.
Figure 3B:
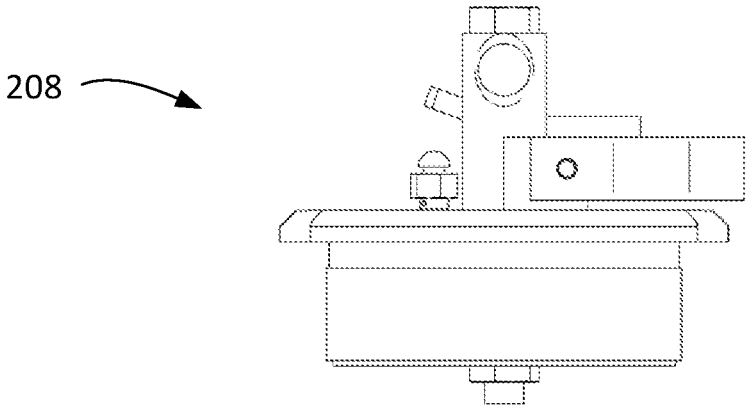
Figure 3C:
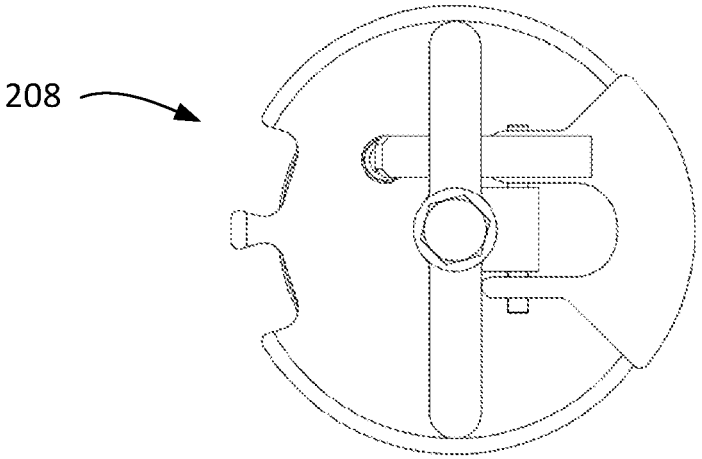

FIGS. 3A, 3B and 3C illustrate a perspective overview, an elevated side view and top view of said venting cap 208.

Figure 4A:
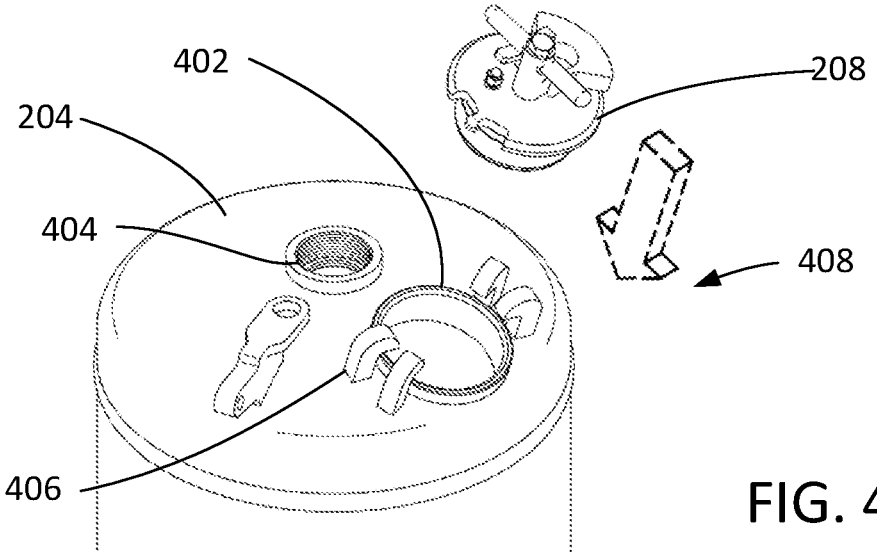
FIGS. 4A, 4B and 4C illustrate a perspective overview of said venting cap 208 in three stages of attachment to a tank 204, in a detached configuration 408, a partially attached configuration 410, and an attached configuration 412.
Figure 4B:
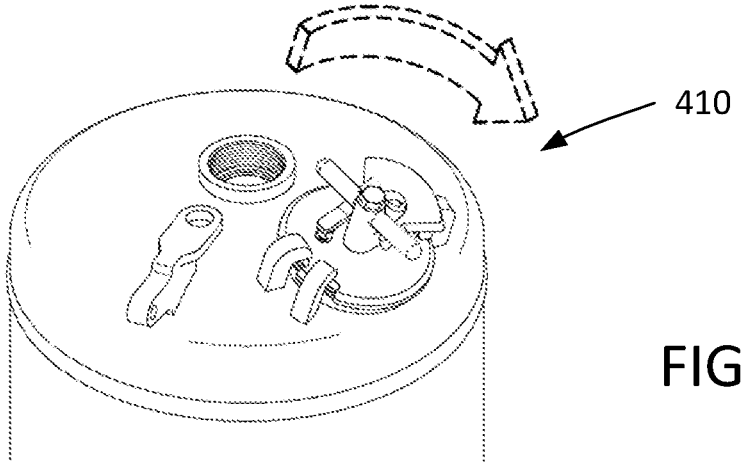
Figure 4C:
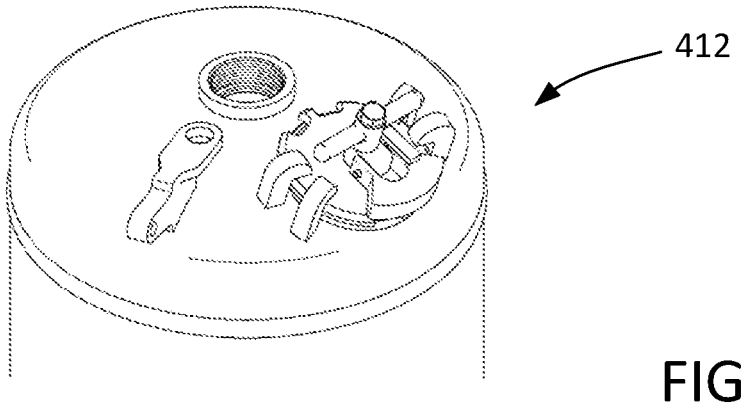

FIGS. 4A, 4B and 4C illustrate a perspective overview of said venting cap 208 in three stages of attachment to said tank 204, in a detached configuration 408, a partially attached configuration 410, and an attached configuration 412.

Said tank 204 can comprise a venting aperture 402, a central top aperture 404, and a plurality of vent cap clamps 406.

Figure 5A:
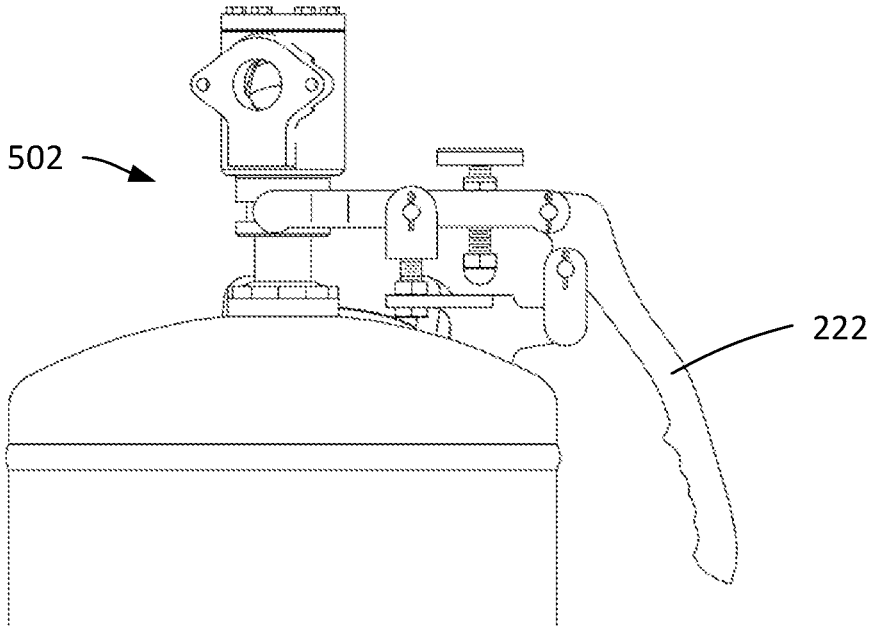
FIGS. 5A and 5B illustrate an elevated side view of said slurry blasting system 202 in a closed lever configuration 502 and an open lever configuration 504.
Figure 5B:
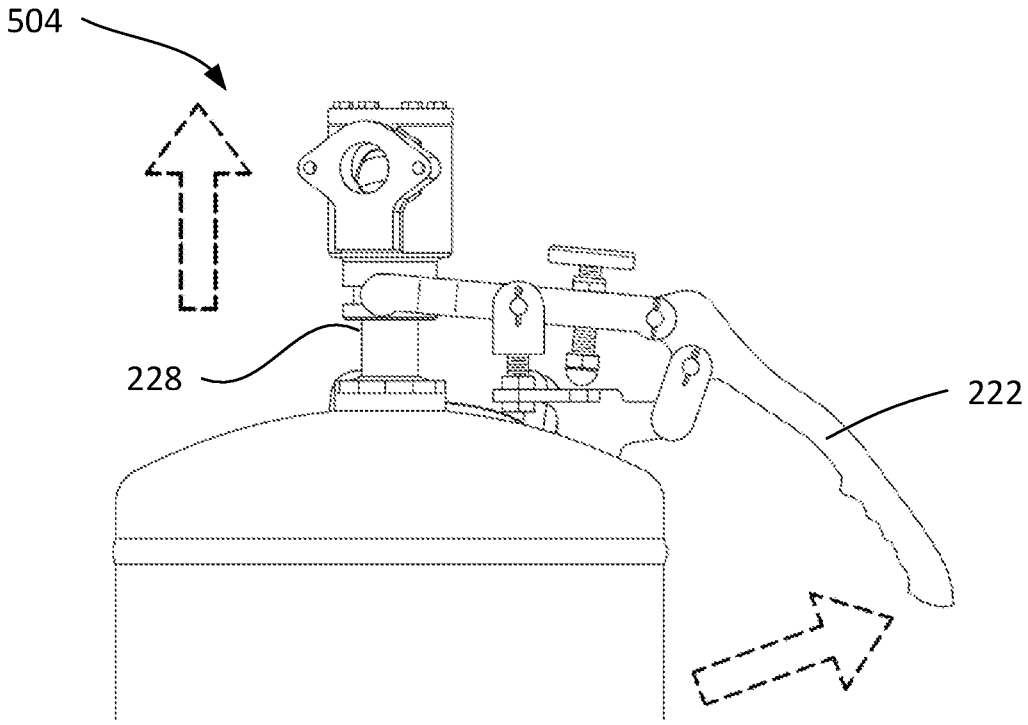

FIGS. 5A and 5B illustrate an elevated side view of said slurry blasting system 202 in a closed lever configuration 502 and an open lever configuration 504.

In one embodiment, said slurry blasting system 202 can comprise said center tube 228 being configured to extend into said tank 204 and move up and down with movement of said lever 222, as illustrated.

Figure 6A:
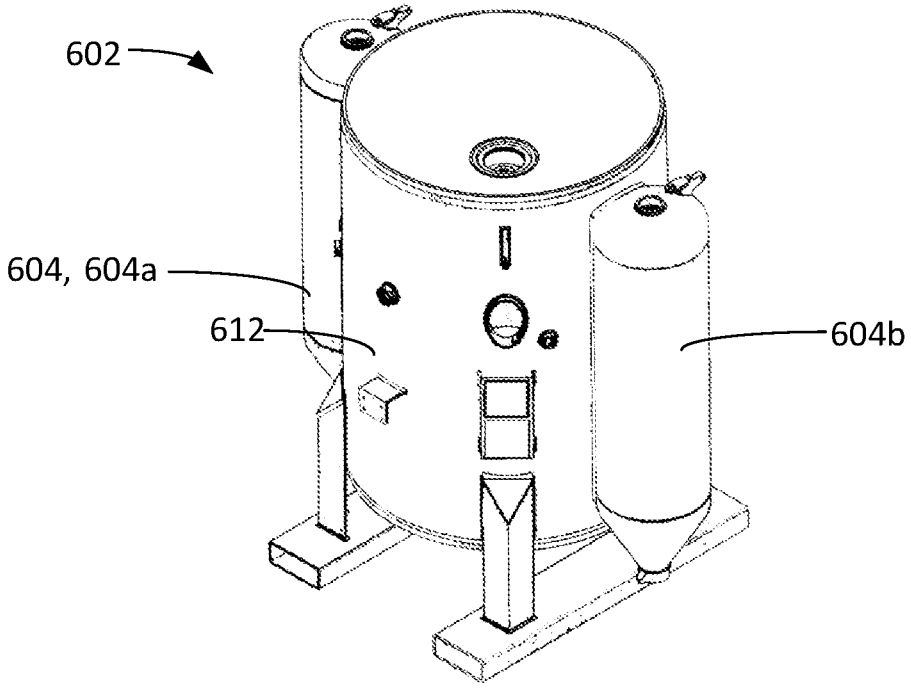
FIGS. 6A and 6B illustrate a perspective overview, and an elevated front view of a multi-tank blasting system 602.
Figure 6B:
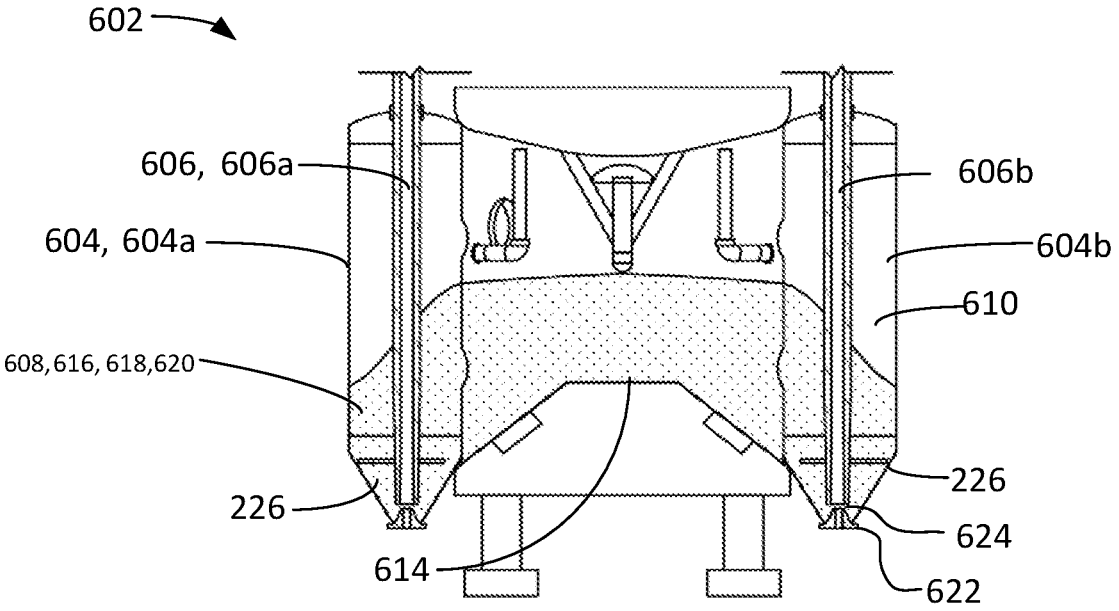

FIGS. 6A and 6B illustrate a perspective overview, and an elevated front view of a multi-tank blasting system 602.

This embodiment, FIGS. 6A-8, has been previously presented in U.S. patent application Ser. No. 15/712,453, which is incorporated by reference.

In one embodiment, said multi-tank blasting system 602 can comprise a plurality of blister assemblies 604 (which can comprise a first blister assembly 604*a*, and a second blister assembly 604*b*). In one embodiment, each among said plurality of blister assemblies 604 can comprise a center tube 606; wherein, said first blister assembly 604*a* can comprise a first center tube 606*a*, and said second blister assembly 604*b* can comprise a second center tube 606*b*. In one embodiment, said multi-tank blasting system 602 can selectively pull portions of said slurry mixture 608 out of said reservoir 610 within said multi-tank blasting system 602 through said second center tube 606*b* or said first center tube 606*a*, according to a user's preferences. In one embodiment, said reservoir 610 can be within a central tank portion 612 and extend to cavities within said plurality of blister assemblies 604, as illustrated.

In one embodiment, said central tank portion 612 can comprise a convex floor 614 to ensure said slurry mixture 608 seeps into said plurality of blister assemblies 604. Said plurality of blister assemblies 604 can be arranged around the edges of said central tank portion 612.

In one embodiment, said plurality of blister assemblies 604 each comprise said conical lower portion 226.

In one embodiment, said slurry mixture 608 can comprise an abrasive 616, a fluid 618, and a rust inhibitor 620, as discussed below. Although not illustrated when discussing said slurry blasting system 202 above, said slurry mixture 608 can be used with either system.

Figure 7A:
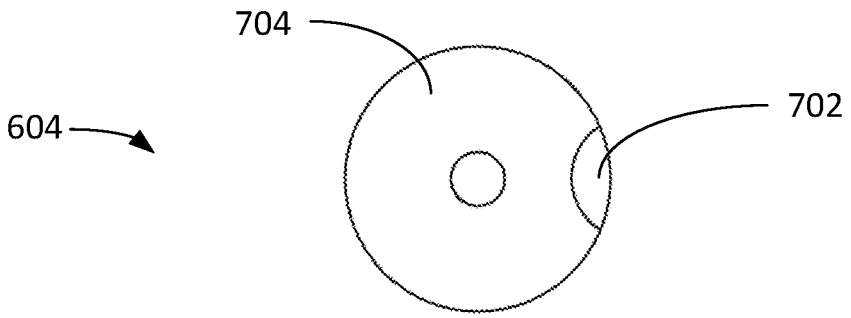
FIGS. 7A and 7B illustrate an elevated top view and elevated side view of one among a plurality of blister assemblies 604.
Figure 7B:
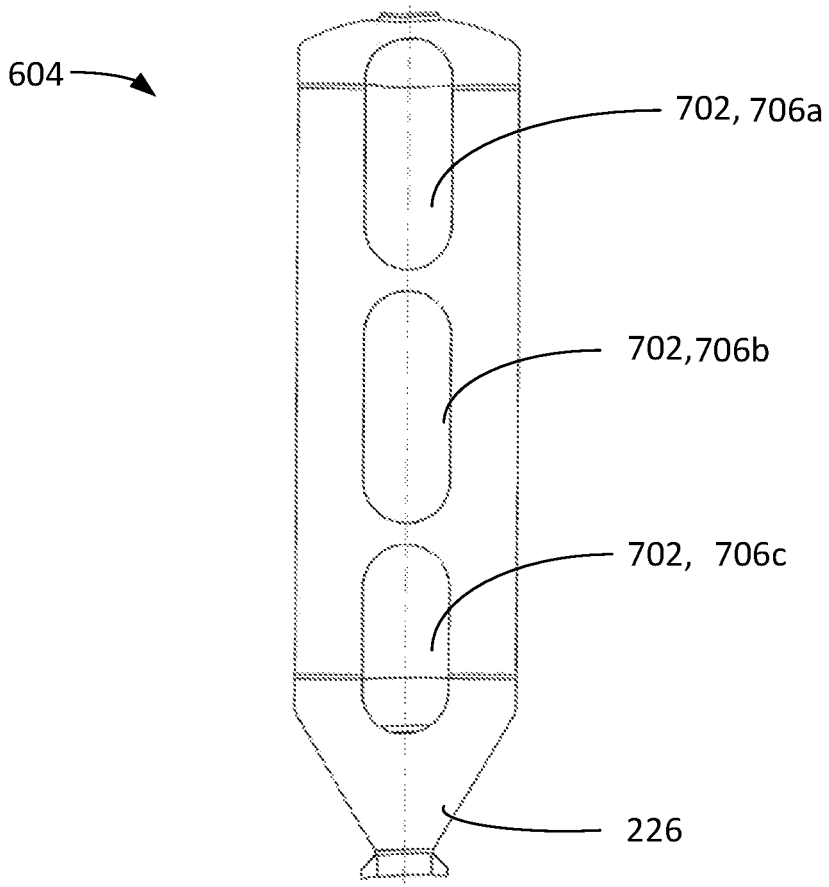

FIGS. 7A and 7B illustrate an elevated top view and elevated side view of one among said plurality of blister assemblies 604.

In one embodiment, said plurality of blister assemblies 604 can comprise a top portion 704, said conical lower portion 226, a plurality of reservoir gaps 702 (which can comprise a first gap 706*a*, a second gap 706*b*, and a third gap 706*c*). In one embodiment, said plurality of blister assemblies 604 a cylindrical shape being enclosed between said top portion 704 and said conical lower portion 226. Said plurality of reservoir gaps 702 can connect with said reservoir 610 within said central tank portion 612.

Figure 8:
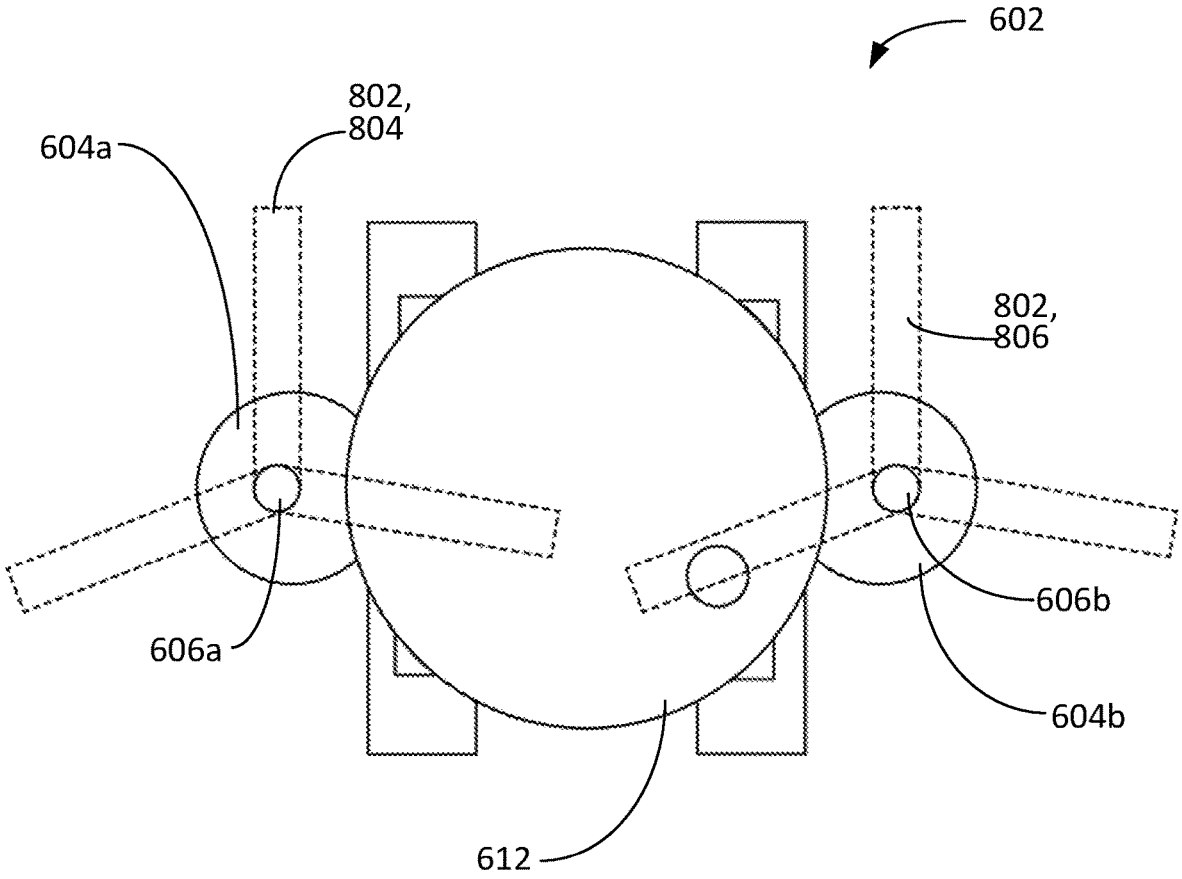
FIG. 8 illustrates an elevated top view of said multi-tank blasting system 602.

FIG. 8 illustrates an elevated top view of said multi-tank blasting system 602.

In one embodiment, said multi-tank blasting system 602 can comprise a plurality of spraying assemblies 802 (which can comprise a first spraying assembly 804 and a second spraying assembly 806).

In one embodiment, said plurality of spraying assemblies 802 can spin in a 360 degree motion around said center tube 606; wherein, said first spraying assembly 804 spins around said first center tube 606*a*, and said second spraying assembly 806 spins around said second center tube 606*b*.

Figure 9A:
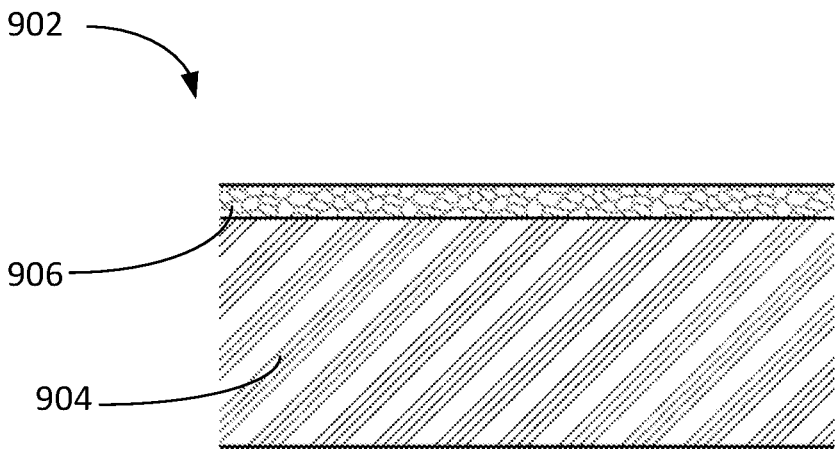
FIGS. 9A and 9B illustrate an elevated cross-section side view of a target object 902.
Figure 9B:
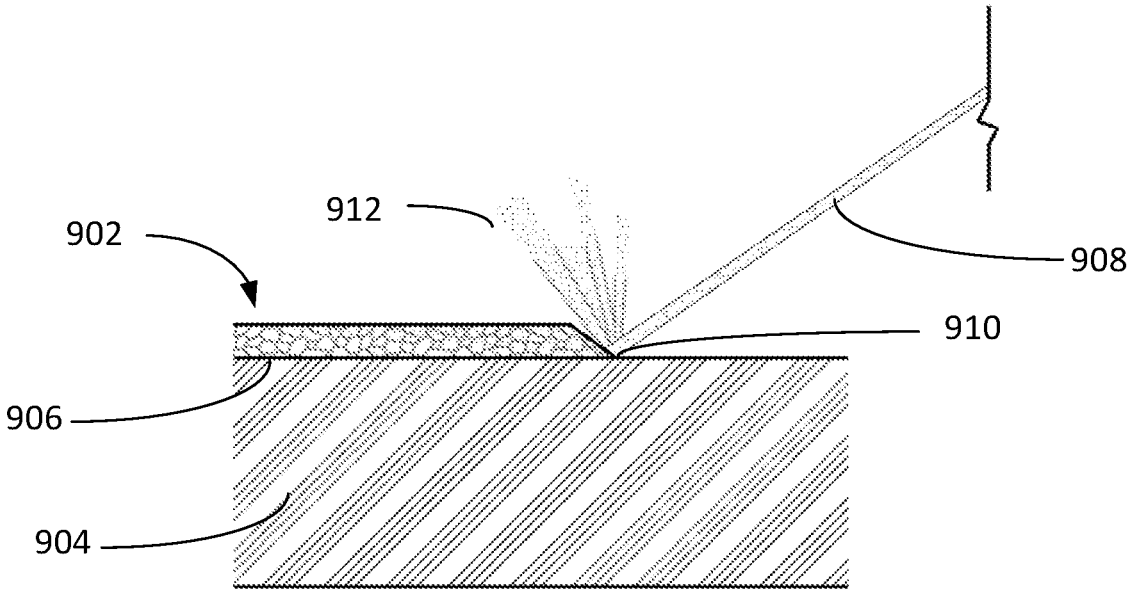

FIGS. 9A and 9B illustrate an elevated cross-section side view of a target object 902.

In one embodiment, said target object 902 can comprise a parent metal 904 and a tarnished top layer 906. Said slurry blasting system 202 and said multi-tank blasting system 602 are configured to spray said slurry mixture 608 in a slurry stream 908.

In one embodiment, said slurry mixture 608 can comprise said abrasive 616, said fluid 618, and said rust inhibitor 620. Said fluid 618 can comprise water. When sprayed at said target object 902, said slurry stream 908 can simultaneously remove said tarnished top layer 906 from said parent metal 904 and apply said rust inhibitor 620. Accordingly, said slurry blasting system 202, and said multi-tank blasting system 602 can remove said tarnished top layer 906 from said parent metal 904 and simultaneously prevent said parent metal 904 from impregnating with contaminants. Thereby, said parent metal 904 can be protected by said rust inhibitor 620 within said slurry mixture 608.

Accordingly, said rust inhibiting process 100 can comprise said mixing step 102 comprising mixing at least said rust inhibitor 620, and said fluid 618 into said slurry mixture 608; said spraying step 104 comprising spraying said slurry mixture 608 at said target object 902 from within said reservoir 610 of said slurry blasting system 202; said exposing step 106 comprising separating said tarnished top layer 906 and said parent metal 904 with said slurry stream 908 created by spraying said slurry mixture 608 of said slurry blasting system 202; said cleaning step 108 comprising cleaning said parent metal 904 with said rust inhibitor 620; said preventative step 110 comprising preventing said parent metal 904 from impregnating with contaminants during cleaning with said rust inhibitor 620; and said protecting step 112 comprising protecting said parent metal 904 with said rust inhibitor 620 after spraying is complete.

In one embodiment, said slurry stream 908 strikes said target object 902 at a strike point 910 and a debris 912 comprising portions of said slurry stream 908 and said tarnished top layer 906 can bounce off of said target object 902.

Figure 10:
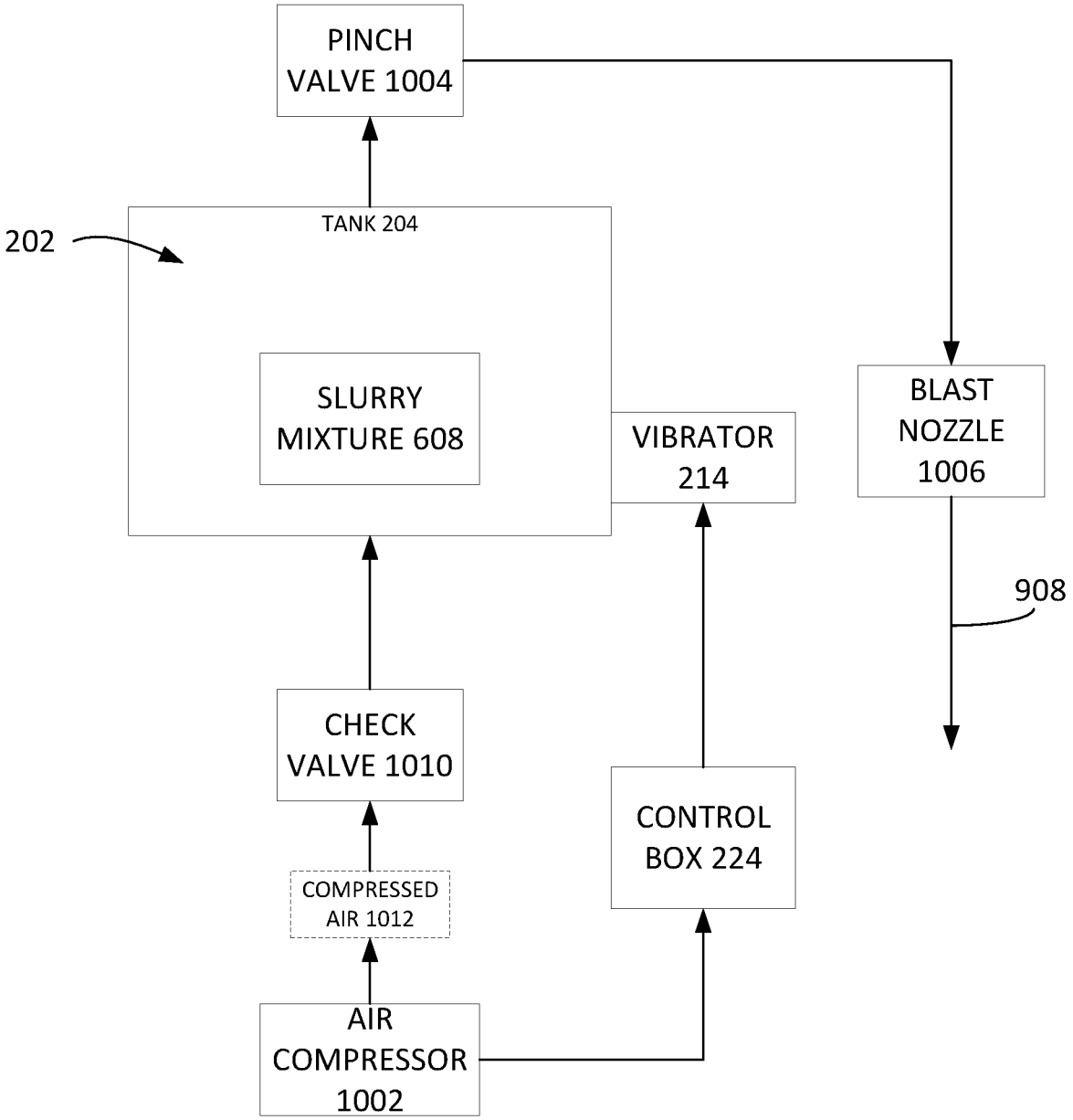
FIG. 10 illustrates a flow chart describing said slurry blasting system 202.

FIG. 10 illustrates a flow chart describing said slurry blasting system 202.

In one embodiment, said slurry blasting system 202 can comprise said slurry mixture 608 in said tank 204, an air compressor 1002, said one or more control boxes 224, said vibrator 214, a pinch valve 1004, a blast nozzle 1006, and a check valve 1010. In one embodiment, said air compressor 1002 can create a compressed air 1012 from atmosphere, as is known in the art.

The following sentences are generated from the original claims and comprise a portion of the preferred embodiments.

Said rust inhibiting process 100 for cleaning and protecting said target object 902 can comprise mixing at least said rust inhibitor 620 and said fluid 618 into said slurry mixture 608, spraying said slurry mixture 608 at said target object 902 from within said reservoir 610 of said slurry blasting system 202, separating said tarnished top layer 906 and said parent metal 904 of said target object 902 with said slurry stream 908, cleaning said parent metal 904 with said rust inhibitor 620, preventing said parent metal 904 from impregnating with contaminants during cleaning with said rust inhibitor 620, and protecting said parent metal 904 with said rust inhibitor 620 after spraying can be complete. Said slurry stream 908 comprises said slurry mixture 608 of said slurry blasting system 202 being sprayed with said slurry blasting system 202. Said slurry blasting system 202 comprises said tank 204. Said center tube 606. Said inlet 216. Said first spraying assembly 804. Said reservoir 610. Said inlet 216 can be configured to receive said compressed air 1012 from said air compressor 1002. Said first spraying assembly 804 can be attached to said center tube 606 and receives a portion of said slurry mixture 608 and directs it at said target object 902.

Said rust inhibiting process 100 for cleaning and protecting said target object 902 can comprise mixing at least said rust inhibitor 620 and said fluid 618 into said slurry mixture 608, spraying said slurry mixture 608 at said target object 902 from within said reservoir 610 of said slurry blasting system 202, separating said tarnished top layer 906 and said parent metal 904 of said target object 902 with said slurry stream 908, cleaning said parent metal 904 with said rust inhibitor 620, preventing said parent metal 904 from impregnating with contaminants during cleaning with said rust inhibitor 620, and protecting said parent metal 904 with said rust inhibitor 620 after spraying can be complete. Said slurry stream 908 comprises said slurry mixture 608 of said slurry blasting system 202 being sprayed with said slurry blasting system 202. Said slurry blasting system 202 comprises said tank 204. Said center tube 606. Said inlet 216. Said first spraying assembly 804. Said reservoir 610. Said inlet 216 can be configured to receive said compressed air 1012 from said air compressor 1002. Said first spraying assembly 804 can be attached to said center tube 606 and receives a portion of said slurry mixture 608 and directs it at said target object 902.

storing said slurry mixture 608 within said tank 204, injecting said compressed air 1012 into a lower end of said center tube 228, opening a gap between said center tube 228 and said tank 204, receiving a portion of said slurry mixture 608 into said compressed air 1012, and selectively spraying a portion of said slurry mixture 608 at said target object 902.

Said tank 204 further comprises said conical lower portion 226 attached to said inlet 216 through A coupler 622. Said coupler 622 receives said compressed air 1012 from said air compressor 1002. Said center tube 228 selectively opens and closes with said coupler 622 to allow portions of said slurry mixture 608 to pass into said center tube 228.

Said center tube 228 can be attached to said blast nozzle 1006 configured to selectively allow said slurry mixture 608 to spray out of said slurry blasting system 202.

Said slurry blasting system 202 further comprises said pinch valve 1004 between said tank 204 and said blast nozzle 1006 configured to selectively stop flow of said slurry mixture 608 out of said tank 204.

storing said slurry mixture 608 within said reservoir 610 of said tank 204, funneling said slurry mixture 608 down into said plurality of blister assemblies 604 adjacent to said tank 204, collecting portions of said slurry mixture 608 in one or more among said plurality of blister assemblies 604 each having one of said center tube 228, injecting said compressed air 1012 into a lower end of said center tube 228, opening A gap 624 between said center tube 228 and said tank 204, receiving a portion of said slurry mixture 608 into said compressed air 1012, and selectively spraying a portion of said slurry mixture 608 at said target object 902.

Various changes in the details of the illustrated operational methods are possible without departing from the scope of the following claims. Some embodiments may combine the activities described herein as being separate steps. Similarly, one or more of the described steps may be omitted, depending upon the specific operational environment the method is being implemented in. It is to be understood that the above description is intended to be illustrative, and not restrictive. For example, the above-described embodiments may be used in combination with each other. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein."

The invention claimed is:

1. A rust inhibiting process for cleaning and protecting a target object comprising:

mixing at least a rust inhibitor and a fluid into a slurry mixture, spraying said slurry mixture at said target object from within a reservoir of a slurry blasting system, separating a tarnished top layer and a parent metal of said target object with a slurry stream, cleaning said parent metal with said rust inhibitor, preventing said parent metal from impregnating with contaminants during cleaning with said rust inhibitor, protecting said parent metal with said rust inhibitor after spraying is complete, storing said slurry mixture within said reservoir of said tank, funneling said slurry mixture down into a plurality of blister assemblies adjacent to said tank, collecting portions of said slurry mixture in one or more among said plurality of blister assemblies each having one of said center tube, injecting said compressed air into a lower end of said center tube, opening a gap between said center tube and said tank, receiving a portion of said slurry mixture into said compressed air, and selectively spraying a portion of said slurry mixture at said target object;

wherein, said slurry stream comprises said slurry mixture of said slurry blasting system being sprayed with said slurry blasting system;

said slurry blasting system comprises a tank; a center tube; an inlet; a first spraying assembly;

said inlet is configured to receive a compressed air from an air compressor; and said first spraying assembly is attached to said center tube and receives a portion of said slurry mixture and directs it at said target object.

2. The rust inhibiting process of claim 1, further comprising:

storing said slurry mixture within said tank, injecting said compressed air into a lower end of a center tube, opening a gap between said center tube and said tank, receiving a portion of said slurry mixture into said compressed air, and selectively spraying a portion of said slurry mixture at said target object.

3. The rust inhibiting process of claim 2, wherein:

said tank further comprises a conical lower portion attached to said inlet through a coupler;

said coupler receives said compressed air from said air compressor; and said center tube selectively opens and closes with said coupler to allow portions of said slurry mixture to pass into said center tube.

4. The rust inhibiting process of claim 3, wherein:

said center tube is attached to a blast nozzle configured to selectively allow said slurry mixture to spray out of said slurry blasting system.

5. The rust inhibiting process of claim 4, wherein:

said slurry blasting system further comprises a pinch valve between said tank and said blast nozzle configured to selectively stop flow of said slurry mixture out of said tank.

6. A rust inhibiting process for cleaning and protecting a target object comprising:

mixing at least a rust inhibitor and a fluid into a slurry mixture, spraying said slurry mixture at said target object from within a reservoir of a slurry blasting system, separating a tarnished top layer and a parent metal of said target object with a slurry stream, cleaning said parent metal with said rust inhibitor, preventing said parent metal from impregnating with contaminants during cleaning with said rust inhibitor, protecting said parent metal with said rust inhibitor after spraying is complete, storing said slurry mixture within said reservoir of said tank, collecting portions of said slurry mixture in said tank having a center tube, injecting said compressed air into a lower end of said center tube, opening a gap between said center tube and said tank, receiving a portion of said slurry mixture into said compressed air, and selectively spraying a portion of said slurry mixture at said target object;

wherein, said slurry stream comprises said slurry mixture of said slurry blasting system being sprayed with said slurry blasting system, said slurry blasting system comprises a tank, a center tube, an inlet, a first spraying assembly, said inlet is configured to receive a compressed air from an air compressor, and said first spraying assembly is attached to said center tube and receives a portion of said slurry mixture and directs it at said target object.

* * * * *